US010273710B2

(12) United States Patent
Yang et al.

(10) Patent No.: US 10,273,710 B2
(45) **Date of Patent: *Apr. 30, 2019**

(54) CENTRAL LOCK AND CANOPY

(71) Applicant: WITH-U E-COMMERCE (SHANGHAI) CO., LTD., Shanghai (CN)

(72) Inventors: Shengyong Yang, Shanghai (CN); Jing Bian, Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/549,164

(22) PCT Filed: Jul. 26, 2016

(86) PCT No.: PCT/CN2016/091675

§ 371 (c)(1),
(2) Date: Aug. 6, 2017

(87) PCT Pub. No.: WO2017/028659

PCT Pub. Date: Feb. 23, 2017

(65) Prior Publication Data

US 2018/0238075 A1 Aug. 23, 2018

(30) Foreign Application Priority Data

Aug. 18, 2015 (JP) ..... 2015-004155 U

(51) Int. Cl.
*E04H 15/50* (2006.01)
*E04H 15/46* (2006.01)
(Continued)

(52) U.S. Cl.
CPC ..... *E04H 15/50* (2013.01); *E04H 15/44* (2013.01); *E04H 15/46* (2013.01); *E05B 65/00* (2013.01); *E04H 15/28* (2013.01)

(58) Field of Classification Search
CPC ..... E04H 15/28; E04H 15/32; E04H 15/36; E04H 15/44; E04H 15/48; E04H 15/50; E04H 15/46; A45B 25/08; E05B 65/00
(Continued)

(56) References Cited

U.S. PATENT DOCUMENTS 233,255 A * 10/1880 Kimble ..... A44C 5/2052 24/658
2,530,765 A * 11/1950 Greenup ..... E04H 15/28 135/120.3
(Continued)

FOREIGN PATENT DOCUMENTS

CN 201620635 U 11/2010
CN 201835613 U 5/2011
(Continued)

*Primary Examiner* — Robert Canfield
(74) *Attorney, Agent, or Firm* — John R. Ross; John R. Ross, III

(57) ABSTRACT

A central lock comprises a center pole (2), a center top cap (1), and a center bottom cap (3). A locking piece (4) is received in the center bottom cap (3); a first through hole (41) is provided in the locking piece (4); and the end part of the center pole (2) is provided with a clamping groove (21) and a clamp locking part (22) located at the lower end of the clamping groove (21). When the central lock is in a locked state, the locking piece (4) is clamped with the clamping groove (21) of the center pole (2), and the locking part (22) abuts against a lower end surface of the locking piece (4); and when the central lock is in an unlocked state, the locking piece (4) is separated from the clamping groove (21), and the clamp locking part (22) can pass through the first through hole (41).

11 Claims, 18 Drawing Sheets

(51) Int. Cl.
*E04H 15/44* (2006.01)
*E05B 65/00* (2006.01)
*E04H 15/28* (2006.01)

(58) Field of Classification Search
USPC .... 135/20.3, 24, 39, 40, 135, 145, 147, 159; 70/34; 292/150
See application file for complete search history.

(56) References Cited

U.S. PATENT DOCUMENTS 5,632,290 A * 5/1997 Ling Kuo ..... A45B 25/143 135/24
6,176,246 B1 * 1/2001 Lin ..... A45B 25/143 135/22
6,796,154 B2 * 9/2004 Gebow ..... B60R 25/09 188/265
6,929,017 B2 * 8/2005 Byun ..... E04H 15/50 135/131
7,984,936 B2 * 7/2011 Lee ..... G06F 1/1616 292/150
8,469,045 B2 * 6/2013 Zhou ..... E04H 15/28 135/135
9,956,981 B1 * 5/2018 Fitzwater ..... B62B 9/142
2003/0062074 A1 * 4/2003 Kuo ..... A45B 25/143 135/24
2003/0183257 A1 * 10/2003 Lee ..... A45B 25/06 135/24
2004/0084074 A1 * 5/2004 Chiu ..... E04H 15/50 135/131
2005/0097829 A1 * 5/2005 Seo ..... E04H 15/50 52/79.1
2007/0131265 A1 * 6/2007 Choi ..... E04H 15/28 135/135
2010/0319743 A1 * 12/2010 Zhou ..... E04H 15/28 135/135
2012/0192906 A1 8/2012 Dankenbring
2014/0174491 A1 6/2014 Yang
2015/0308147 A1 * 10/2015 Lee ..... E04H 1/1205 135/145
2016/0348392 A1 * 12/2016 Jin ..... E04H 15/50
2018/0125184 A1 * 5/2018 Song ..... E04H 15/34
2018/0128006 A1 * 5/2018 Song ..... E04H 15/28
2018/0209167 A1 * 7/2018 Yang ..... E04H 15/50
2018/0298631 A1 * 10/2018 Yang ..... E04H 15/46

FOREIGN PATENT DOCUMENTS

CN 202125133 U 1/2012
CN 203846854 U 9/2014
CN 204024196 U 12/2014
EP 743222 A2 * 11/1996
JP 2017160784 A * 9/2017

* cited by examiner

A-A

B-B

C-C

D-D

E-E

J-J

CENTRAL LOCK AND CANOPY

CROSS REFERENCE TO RELATED PATENT APPLICATION

The present application is the US national stage of PCT/CN2016/091675 filed on Jul. 26, 2016, which claims the priority of JP 2015-004155U filed on Aug. 18, 2015, which application is incorporated herein by reference.

FIELD OF INVENTION

The present invention relates to an outdoor product, in particular to a central lock and a canopy.

DESCRIPTION OF RELATED ARTS

With the continuous improvement of people's life, the use of canopys is increasingly frequent. Generally each canopy comprises a foldable canopy frame and a canopy fabric, the canopy frame consists of a roof frame and four or more supporting legs, the supporting legs are used for supporting the roof frame and are provided with a locking structure on each supporting leg respectively, the canopy fabric covers the roof frame and is used for sunshading, rain sheltering or wind sheltering. At present, the locking structure is generally a locking pin, and an unfolded state of the canopy is locked by way of respectively locking each supporting leg. However, this way has the following defects:

In a process that a canopy is unfolded or folded, a user needs to perform a locking operation or an unlocking operation on a locking mechanism of each supporting leg one by one when unfolding or folding the canopy, the operation is cumbersome, functional defects or misoperation of forcing unlocking would be caused if it is forgotten, and the unfolding or folding of the canopy needs cooperation of many people such that the canopy can be erected. In addition, in a process that the canopy is unfolded and is erected, stresses of stress points of a plurality of supporting legs are not uniform, thus it is very difficult to support the canopy at optimum points and consequently the supporting effect of the canopy is influenced. Besides, damages to the canopy are mostly appeared at the supporting legs of the canopy, since positions of sliding blocks need to be fixed after the canopy is unfolded, and holes are opened in the supporting legs at the fixing positions of the sliding blocks for inserting locking pins. Opening holes in the supporting legs weakens supporting strength of the supporting legs, and the supporting legs are usually damaged at the fixing positions of the sliding blocks and consequently the service life of the canopy is shortened.

SUMMARY OF THE PRESENT INVENTION

In view of the above-mentioned disadvantages of the prior art, one technical problem to be solved by the present invention is to provide a central lock enabling to support an entire canopy and enabling the canopy to be uniformly stressed.

In order to realize the above-mentioned purpose, the present invention provides a central lock comprising a center pole, a center top cap fixedly arranged at one end of the center pole, and a center bottom cap detachably connected to the other end of the center pole, a locking piece capable of moving back and forth along a radial direction of the center pole is received in the center bottom cap, a first through hole through which the center pole can pass is provided in the locking piece, and the end part of the center pole is provided with a clamping groove and a clamp locking part located at the lower end of the clamping groove; when the central lock is in a locked state, part of an inner wall of the first through hole of the locking piece is clamped with the clamping groove of the center pole, and an upper end surface of the clamp locking part abuts against a lower end surface of the locking piece; when the central lock is in an unlocked state, the inner wall of the first through hole of the locking piece is separated from the clamping groove, and the clamp locking part can pass through the first through hole.

Another technical problem to be solved by the present invention is to provide a canopy having a good supporting effect and uniform stress.

In order to realize the above-mentioned purpose, the present invention provides a canopy comprising at least three supporting legs, outer retractable units connected between every two adjacent supporting legs and inner retractable units connected to each supporting leg, the outer retractable units and the inner retractable units form a roof frame of the canopy; the canopy further comprises the above-mentioned central lock, and inner ends of the inner retractable units are connected through the central lock.

As described above, the central lock and the canopy provided by the present invention have the following beneficial effects:

In the central lock, clamping or separation between the center pole and the locking piece can be achieved through a movement of the locking piece, thereby detachable connection between the center pole and the center bottom cap is achieved, thus with the central lock is applied to the canopy and the canopy is unfolded, the entire canopy can be supported by connecting the center pole with the center bottom cap, the operation is very convenient, uniform stress of each supporting leg of the canopy is guaranteed, and the overall supporting effect of the canopy is improved. In addition, with the canopy with the central lock is unfolded, the canopy can be fixed by connecting the center pole with the center bottom cap, and holes for fixing sliding blocks are not necessary in the supporting legs of the canopy, thereby the strength of the supporting legs of the canopy is enhanced, the structural strength of the canopy is enhanced and the service life of the canopy is prolonged.

DESCRIPTION OF REFERENCE NUMERALS

Figure 1:
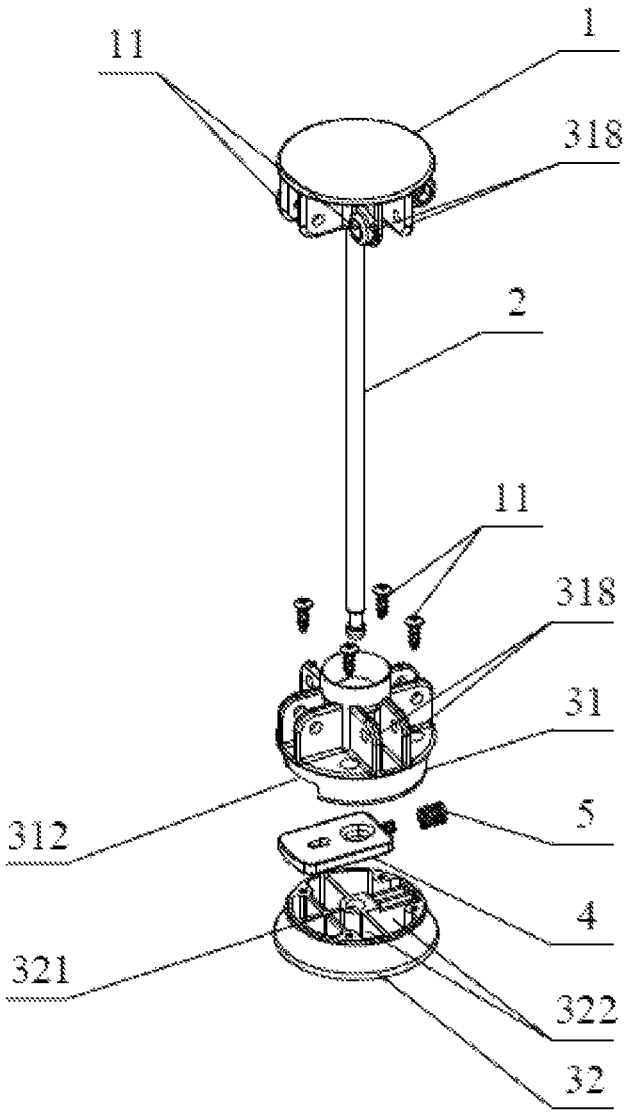
FIG. 1 illustrates an exploded view of a central lock of the present invention.

1 Center top cap
2 Center pole
3 Center bottom cap
4 Locking piece
5 Spring
6 Supporting leg
7 Outer retractable unit
8 Inner retractable unit
9 Sliding sleeve
10 Fixed joint
11 Screw
21 Clamping groove
22 Clamp locking part
31 Bottom cap seat
32 Bottom cap cover
41 First through hole
42 Groove
43 Guide supporting part
44 Locking piece pressing part
45 Elastic wire
46 Unlocking push piece
71 First eave pipe
72 Second eave pipe
81 First oblique top pipe
82 Second oblique top pipe
83 First connecting rod
84 Second connecting rod
85 Third oblique top pipe
86 Fourth oblique top pipe
221 Guide part
311 Receiving chamber
312 Opening
313 Detachment preventing part
314 Second through hole
315 First conical part
316 Cylindrical part
317 Second conical part
318 Connection piece
321 Receiving hole
322 Material reducing groove
411 Clamping hole part
412 Through hole part
413 Chamfered part
451 Elastic wire body part
452 Elastic deforming part
453 Narrow opening
454 Socket
461 Guide surface

DETAILED DESCRIPTION OF THE PREFERRED EMBODIMENTS

Figure 2:
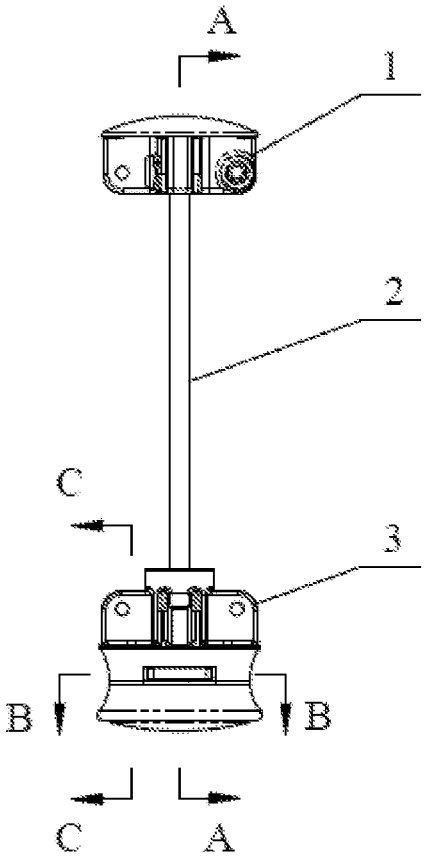
FIG. 2 illustrates a structural schematic view of a central lock in a locked state.
Figure 3:
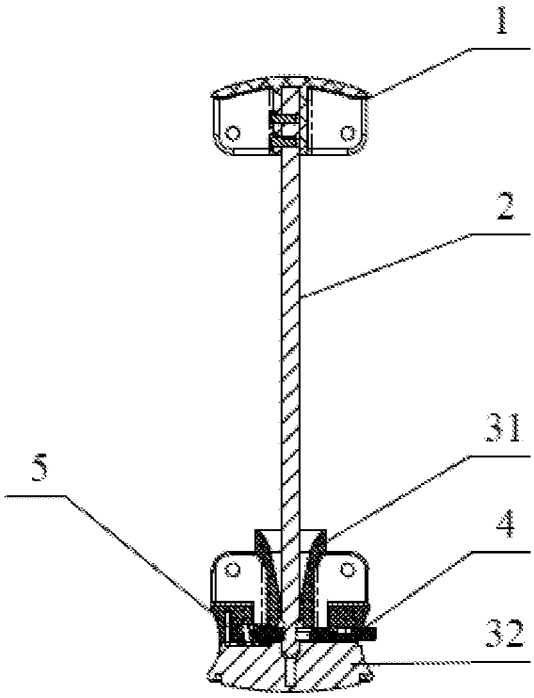
FIG. 3 illustrates an A-A sectional view of FIG. 2.
Figure 6:
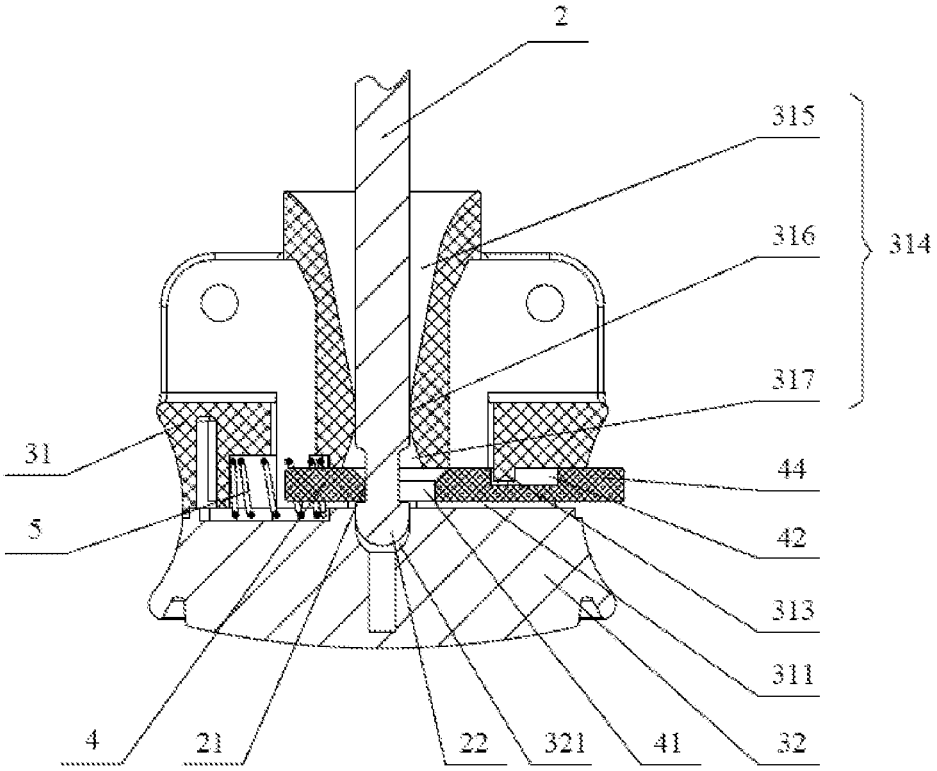
FIG. 6 illustrates a schematic view of a connection between a center pole and a center bottom cap in FIG. 2.
Figure 7:
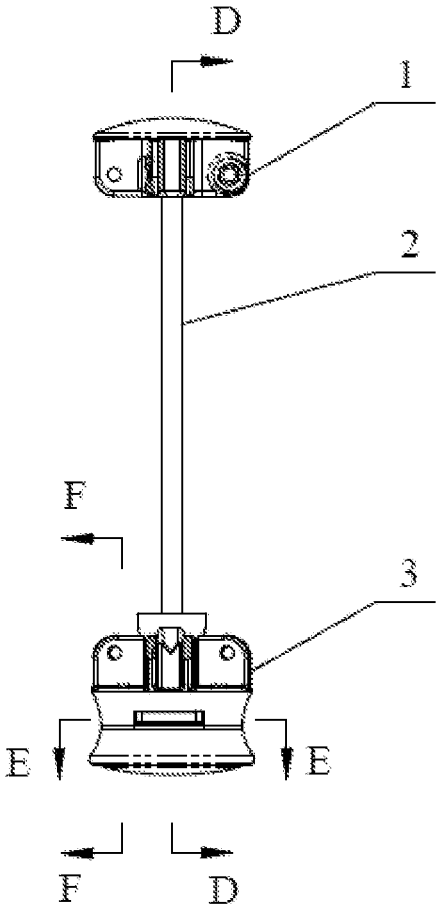
FIG. 7 illustrates a structural schematic view of a central lock in an unlocked state.
Figure 8:
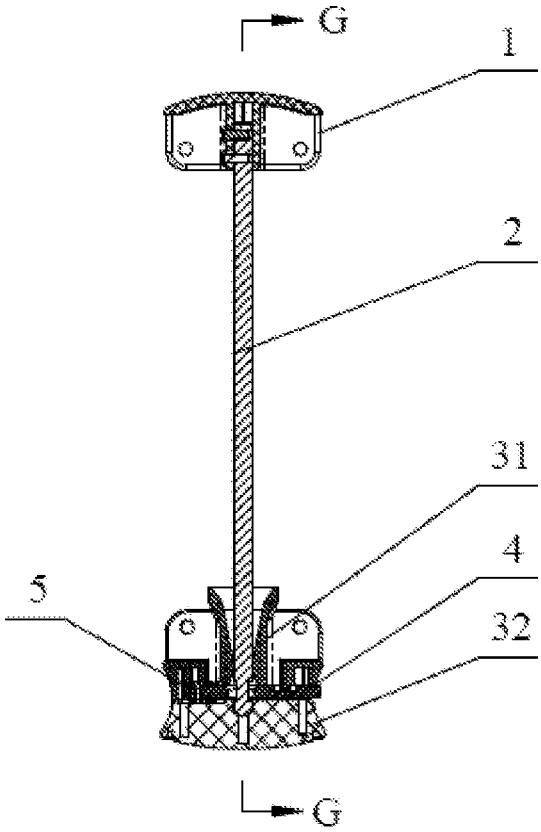
FIG. 8 illustrates a D-D sectional view of FIG. 7.
Figure 11:
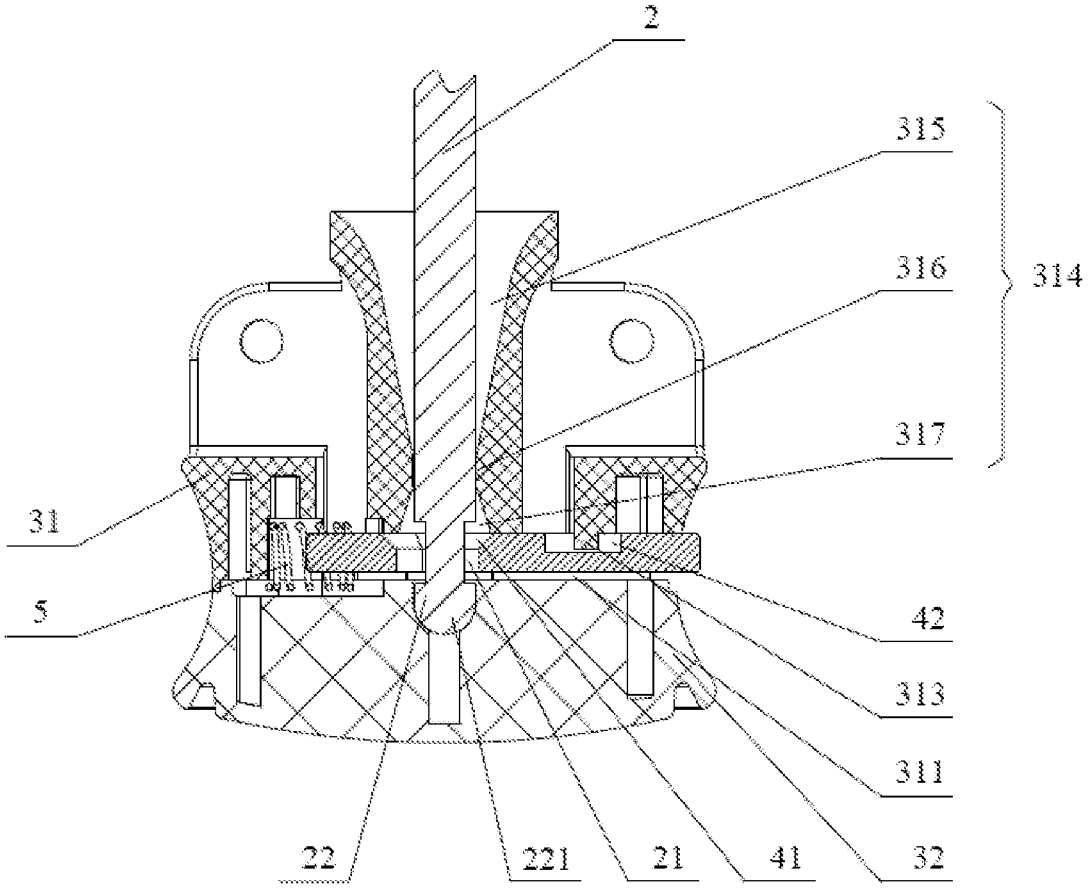
FIG. 11 illustrates a schematic view of a connection between a center pole and a center bottom cap in FIG. 7.
Figure 12:
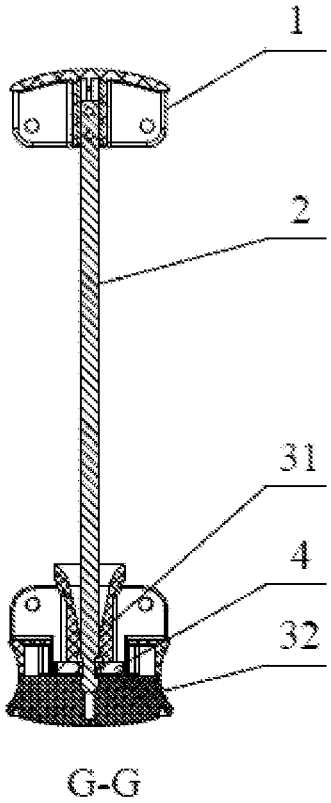
FIG. 12 illustrates a G-G sectional view of FIG. 8.

The present invention provides a central lock and a canopy mounted with the central lock. As illustrated in FIG. 1 and FIG. 2, the central lock comprises a center pole 2, a center top cap 1 fixedly arranged at one end of the center pole 2, and a center bottom cap 3 detachably connected to the other end of the center pole 2. As illustrated in FIG. 1, the center top cap 1 is fixedly connected with one end of the center pole 2 through a screw 11; a detachable connection structure between the center bottom cap 3 and the other end of the center pole 2 is as illustrated in FIG. 2 to FIG. 12, a locking piece 4 capable of moving back and forth along a radial direction of the center pole 2 is received in the center bottom cap 3, a first through hole 41 through which the center pole 2 can pass is provided in the locking piece 4, and the end part of the center pole 2 is provided with a clamping groove 21 and a clamp locking part located at the lower end of the clamping groove 21. When the central lock is in a locked state, as illustrated in FIG. 6, part of an inner wall of the first through hole 41 of the locking piece 4 is clamped with the clamping groove 21 of the center pole 2, an upper end surface of the clamp locking part 22 abuts again a lower end surface of the locking piece 4, thus the clamp locking part 22 can not thread the first through hole 41 and the center pole 2 and the center bottom cap 3 are in a mutually connected state. When the central lock is in an unlocked state, as illustrated in FIG. 11, the locking piece 4 moves along the radial direction of the center pole 2 such that the inner wall of the first through hole 41 of the locking piece 4 is separated from the clamping groove 21, the clamp locking part 22 can thread the first through hole 41, thus the center pole 2 can be moved out of the center bottom cap 3 such that the center pole 2 is separated from the center bottom cap 3.

Figure 16:
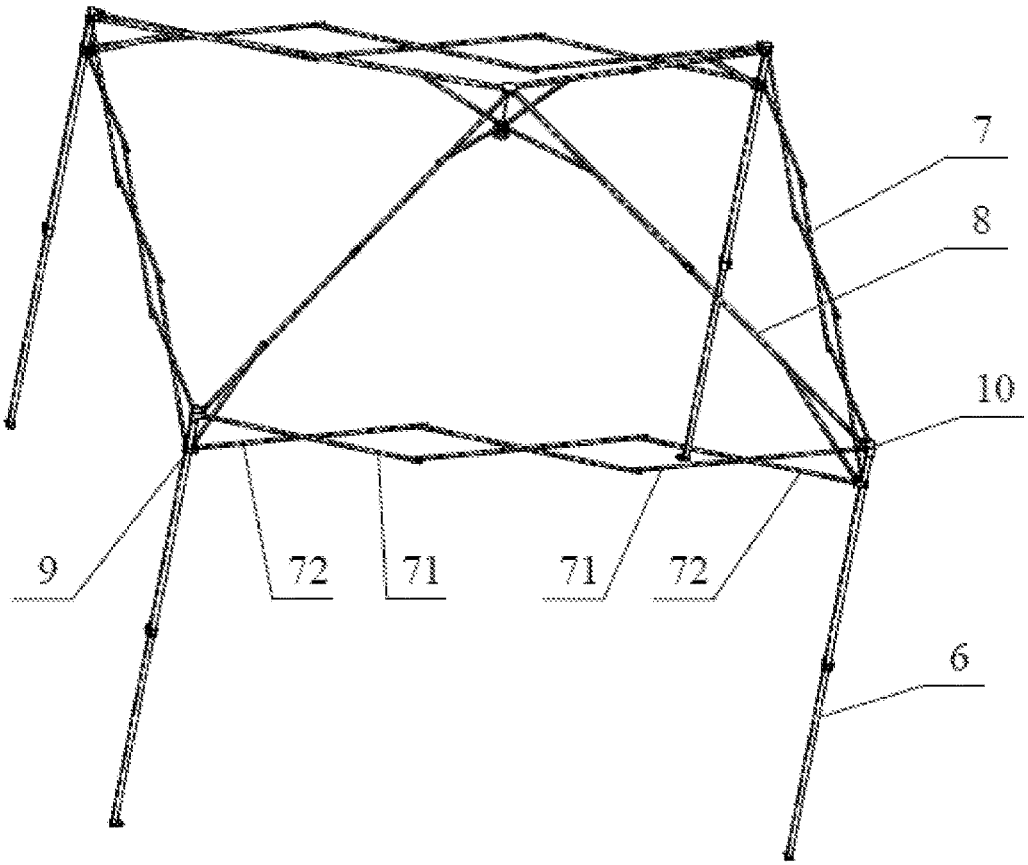
FIG. 16 illustrates a structural schematic view of a canopy in an unfolded state of the present invention.

Further, the central lock is mainly mounted in a canopy, so that the canopy can have a better supporting effect. Of course, the central lock may also be mounted in other devices. As illustrated in FIG. 16, the canopy mounted with the central lock comprises at least three supporting legs 6, outer retractable units 7 connected between every two adjacent supporting legs 6 and inner retractable units 8 connected to each supporting leg 6, the outer retractable units 7 and the inner retractable units 8 form a roof frame of the canopy, the roof frame and the plurality of supporting legs 6 form a canopy frame of the canopy, a canopy fabric covers the roof frame, and inner ends of the inner retractable units 8 of the canopy are connected through the central lock. In this embodiment, there are four supporting legs 6. Accordingly, there are four outer retractable units 7 and four inner retractable units 8 respectively. In addition, for convenience of operation, the center top cap 1 is located at an upper end of the center pole 2 and the center bottom cap 3 is located at a lower end of the center pole 2, so that the center bottom cap 3 can be pulled upwards or downwards conveniently.

Figure 19:
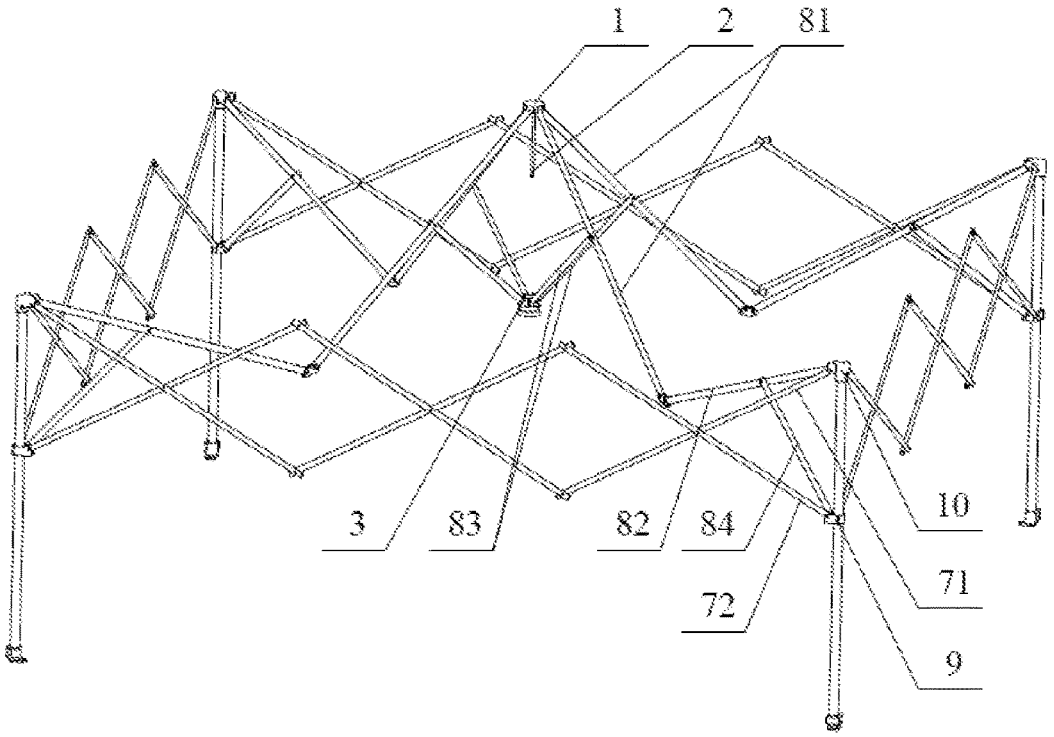
FIG. 19 illustrates a state view of a canopy in an unfolding or folding process.
Figure 20:
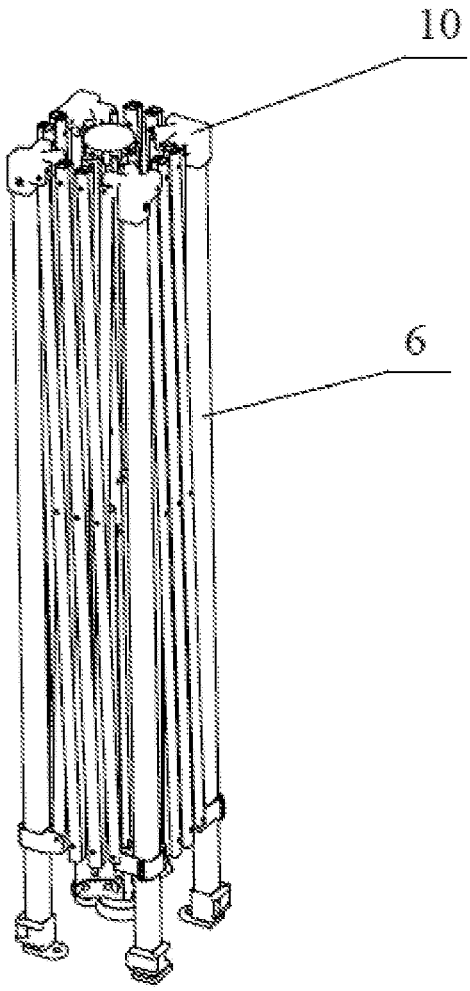
FIG. 20 illustrates a structural schematic view of a canopy after being folded.

When the canopy is in a folded state, as illustrated in FIG. 20, the center top cap 1 and the center bottom cap 3 of the central lock are in a mutually separated state. When the canopy is unfolding, as illustrated in FIG. 19, the four supporting legs 6 are centered about the central lock and unfolded outwards, the outer retractable units 7 and the inner retractable units 8 are gradually stretched outwards. After the canopy is unfolded, the center bottom cap 3 is pushed towards the center pole 2, i.e., the center bottom cap 3 moves upwards such that the center pole 2 is inserted into the center bottom cap 3 and the clamping groove 21 of the center pole 2 is clamped with part of the inner wall of the first through hole 41, thus part of the upper end surface of the clamp locking part 22 abuts against part of the lower end surface of the locking piece 4, so as to restrict the clamp locking part 22 from passing through the first through hole 41 and further to restrict the center pole 2 from falling out of the center bottom cap 3, accordingly, the mutual connection between the center bottom cap 3 and the center pole 2 is achieved. After the center bottom cap 3 is connected with the center pole 2, the unfolded state of the canopy is fixed and maintained, the entire canopy is locked, at this point, the inner retractable units 8, as well as the outer retractable units 7 accordingly, can not automatically extend and retract with no external force, and thus the stability of the unfolded state of the canopy is very good. The plurality of inner retractable units 8 are uniformly distributed at the periphery of the central lock, such that each inner retractable unit 8 is uniformly stressed and each supporting leg 6 averagely undertakes the gravity of the roof frame, so as to improve the overall supporting effect of the canopy. In addition, as the canopy mounted with the central lock is unfolded, the canopy can be fixed by connecting the center pole with the center bottom cap. As compared with the mechanical locking method in which the sliding blocks are fixed by locking pins in the prior art, there is no need to fix the sliding blocks in the supporting legs in the present application, thereby it is not necessary to provide holes in the supporting legs of the canopy for fixing the sliding blocks, accordingly the strength of the supporting legs of the canopy is enhanced, the structural strength of the canopy is enhanced and the service life of the canopy is prolonged. When the canopy is folded, the locking piece 4 is moved such that the inner wall of the first through hole 41 of the locking piece 4 is separated from the clamping groove 21, at this point, the clamp locking part 22 can pass through the first through hole 41, and the center pole 2 also can move out of the center bottom cap 3 to separate the center pole 2 from the center bottom cap 3; and thereafter, force is applied to pull the center bottom cap 3 away from the center pole 2, i.e., the center bottom cap 3 is pulled downwards to enable the inner retractable units 8 to be folded towards the central lock, as illustrated in FIG. 19, finally the outer retractable units 7 are gradually folded and the plurality of supporting legs 6 are folded towards the central lock, as illustrated in FIG. 20. To sum up, the canopy mounted with the central lock of the present invention is very convenient to be unfolded or folded, and has good support effect and high strength after the canopy is unfolded, and has long service life; the central lock is simple in structure, easy to manufacture and low in cost.

Figure 17:
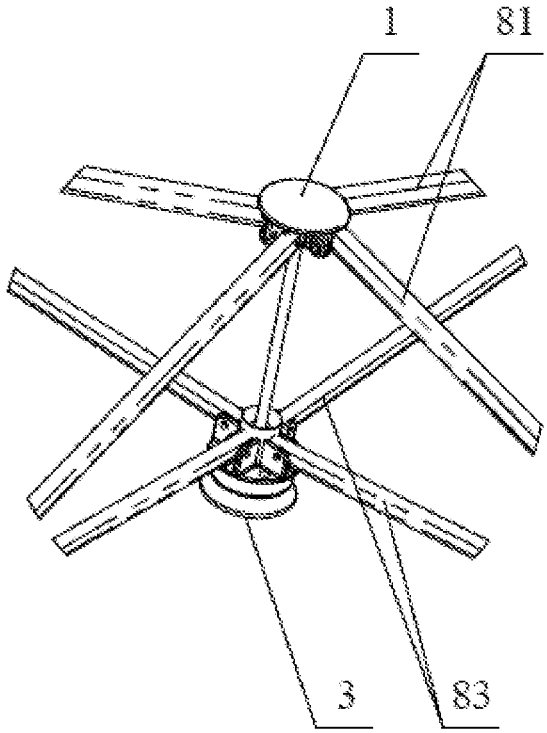
FIG. 17 illustrates a structural schematic view of the central lock in FIG. 16.
Figure 18:
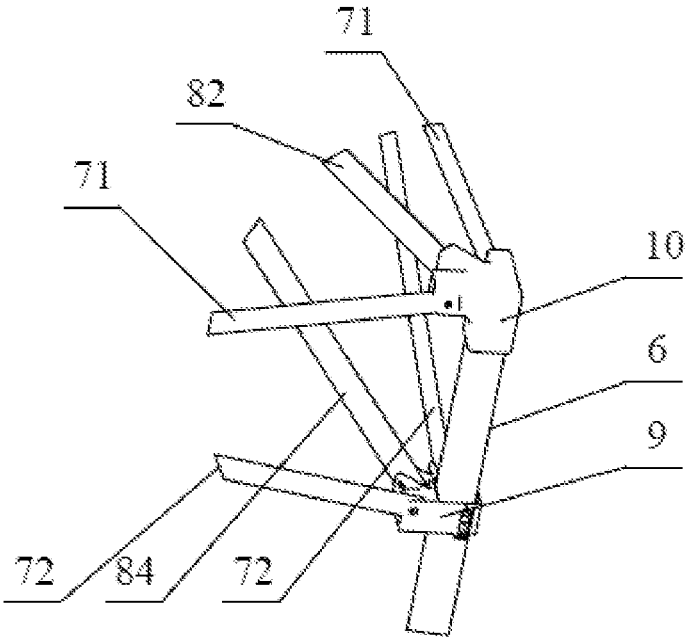
FIG. 18 illustrates a schematic view of a connection of the sliding block, the fixed joint and the supporting leg in FIG. 16.
Figure 21:
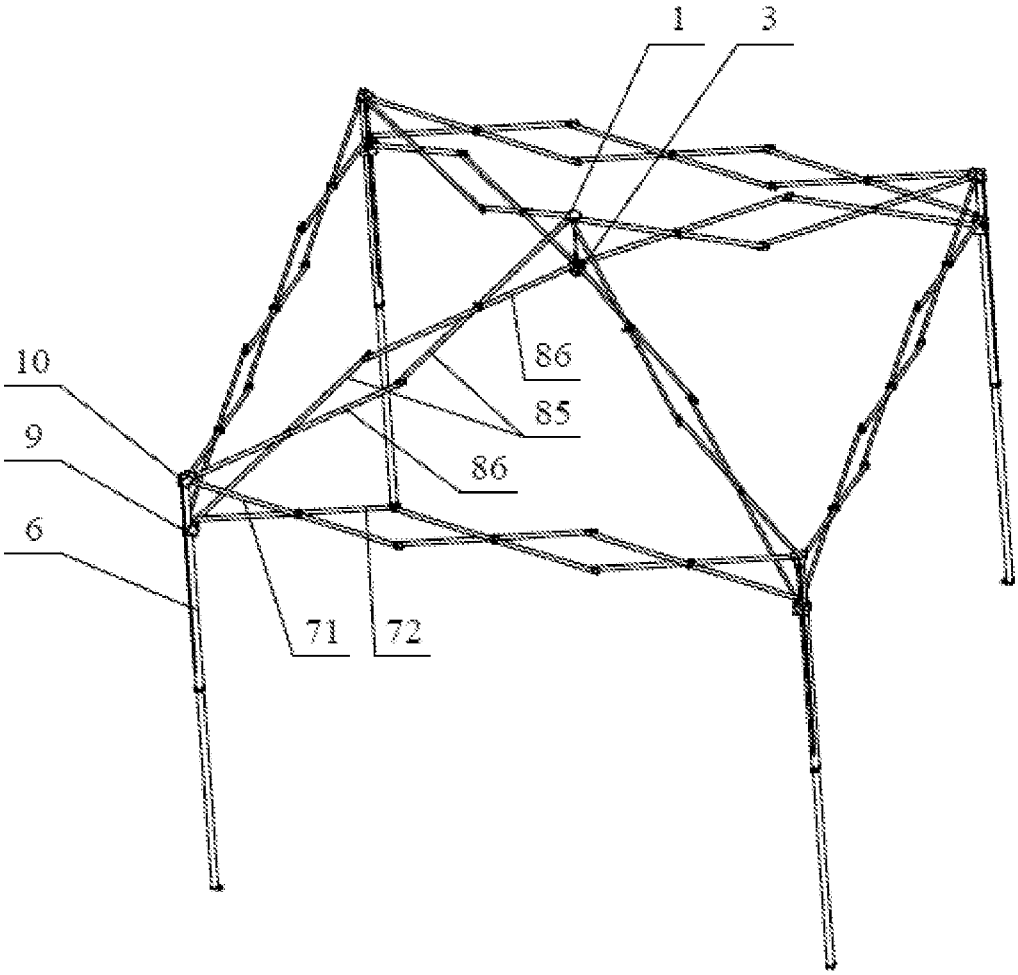
FIG. 21 illustrates another embodiment of a canopy.
Figure 22:
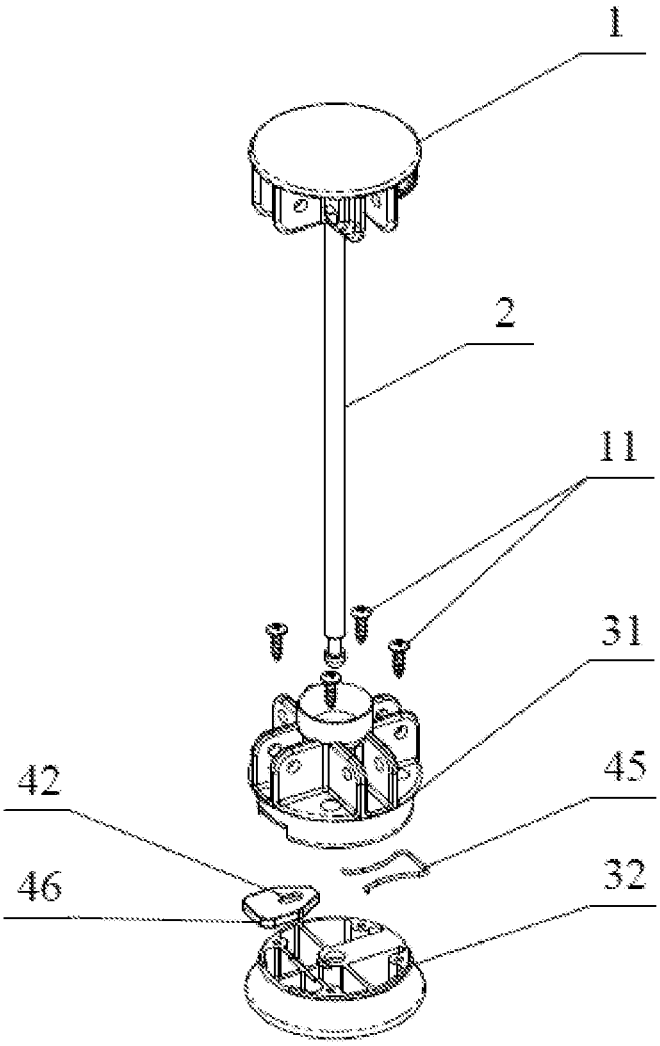
FIG. 22 illustrates another embodiment of a central lock of the present invention.

Further, as illustrated in FIG. 16 to FIG. 18, each supporting leg 6 is sleeved with a sliding sleeve 9 for moving along a length direction of the supporting leg 6, an upper end of each supporting leg 6 is fixed with a fixed joint 10. The outer retractable unit 7 comprises three hinged X-shaped rod members, each X-shaped rod member comprises a first eave pipe 71 and a second eave pipe 72 hinged to one another, with a hinging point between the first eave pipe 71 and the second eave pipe 72 being located at or close to a midpoint of the first eave pipe 71 or the second eave pipe 72. The inner retractable unit 8 comprises a first oblique top pipe 81 and a second oblique top pipe 82 hinged to one another through a connection piece with a U-shaped cross section, a first connecting rod 83 is hinged at or close to a midpoint of the first oblique top pipe 81, a second connecting rod 84 is hinged at or close to a midpoint of the second oblique top pipe 82; inner ends of four first oblique top pipes 81 are all hinged with the center top cap 1 of the central lock, inner ends of four first connecting rods 83 are all hinged with the center bottom cap 3 of the central lock. The fixed joint 10 at the upper end of the supporting leg 6 is hinged with outer ends of the first eave pipes 71 of two X-shaped rod members and an outer end of one second oblique top pipe 82, the sliding sleeve 9 on the supporting leg 6 is hinged with outer ends of the second eave pipes 72 of two X-shaped rod members and an outer end of one second connecting rod 84. In this embodiment, the first oblique top pipe 81 and the first connecting rod 83, as well as the second oblique top pipe 82 and the second connecting pipe 84, forms a Y-shaped member, i.e., the inner retractable unit 8 consists of a plurality of Y-shaped members. In another embodiment, the inner retractable unit 8 may also consists of a plurality of X-shaped members, as illustrated in FIG. 21, at this point, each X-shaped member of the inner retractable unit 8 comprises a third oblique top pipe 85 and a fourth oblique top pipe 86 hinged to one another. As for the innermost X-shaped member of the inner retractable unit 8, an inner end of the third oblique top pipe 85 is hinged with the center top cap 1 of the central lock, and an inner end of the fourth oblique top pipe 86 is hinged with the center bottom cap 3 of the central lock. As for the outermost X-shaped member of the inner retractable unit 8, an outer end of the third oblique top pipe 85 is hinged with the sliding sleeve 9, and an outer end of the fourth oblique top pipe 86 is hinged with the fixed joint 10.

As for the roof frame of the canopy with the above-mentioned structure, in the process that the center bottom cap 3 of the central lock is pushed upwards to unfold the canopy, the upward movement of the center bottom cap 3 enables the inner retractable units 8 to extend outwards; and simultaneously the sliding sleeve 9 is enabled to move upwards along the length direction of the supporting leg 6, such that the outer retractable units 7 and the four supporting legs 6 gradually extend until the entire canopy is fully unfolded and the center bottom cap 3 is connected with the lower end of the center pole 2. Contrarily, after the center bottom cap 3 is separated from the lower end of the center pole 2, in the process that the center bottom cap 3 is pulled downwards, the downward movement of the center bottom cap 3 enables the inner retractable units 8 to fold inwards; and simultaneously the sliding sleeve 9 is enabled to move downwards along the length direction of the supporting leg 6, such that the outer retractable units 7 and the four supporting legs 6 gradually fold until the entire canopy is fully folded.

Further, as illustrated in FIG. 1, FIG. 6 and FIG. 11, the center bottom cap 3 comprises a bottom cap seat 31 and a bottom cap cover 32 that are connected to one another fixedly through a plurality of screws, a receiving chamber 311 is provided in the center bottom cap 3 at a junction between the bottom cap seat 31 and the bottom cap cover 32, an opening 312 communicated with the receiving chamber 311 is provided in an outer wall of the center bottom cap 3, and the locking piece 4 is provided threading the receiving chamber 311 and the opening 312, located between the bottom cap seat 31 and the bottom cap cover 32, and supported by the bottom cap cover 32. The receiving chamber 311 may be fully disposed in the bottom cap seat 31, or in the bottom cap cover 32, or in the bottom cap seat 31 and the bottom cap cover 32 together. The bottom cap seat 31 and the bottom cap cover 32 are detachably connected through the screws, thereby facilitating the mounting of the center bottom cap 3 and the locking piece 4. In addition, there are eight connection pieces 318 provided in the bottom cap seat 31 of the center bottom cap 3 and the center top cap 1 respectively, the eight connection pieces 318 form four connection piece groups which are provided at intervals of 90°, i.e., each connection piece group comprises two connection pieces 318, with a receiving groove being formed between the two connection pieces 318. The inner ends of the four first oblique top pipes 81 are disposed in the four receiving grooves in the center top cap 1 and hinged with the connection pieces 318 through bolts respectively, and threads at end portions of the bolts are connected with nuts. The inner ends of the four first connecting rods 83 are disposed in the four receiving grooves of the bottom cap seat 31 and hinged with the connection pieces 318 through bolts respectively, and threads at end portions of the bolts are connected with nuts.

In the present application, there are two embodiments for the locking piece 4. The first embodiment of the locking piece 4 is as illustrated in FIG. 1 to FIG. 15, and the second embodiment of the locking piece 4 is as illustrated in FIG. 21 to FIG. 26. Specifically, in the first embodiment, the locking piece 4 is an integral member, i.e., an integral structure. At this point, as illustrated in FIG. 6 and FIG. 11, the receiving chamber 311 is provided with a compressible elastic element along the radial direction of the center pole 2, the elastic element abuts against the locking piece 4 and an inner wall of the receiving chamber 311 at two ends respectively. The bottom cap seat 31 is provided with a protruding detachment preventing part 313, the locking piece 4 is provided with a groove 42 for receiving the detachment preventing part 313. When the central lock is in a locked state, the locking piece 4 applies an acting force to center pole 2 in the radial direction by means of elastic force of the elastic element, to enable part of the inner wall of the first through hole 41 to be located in the clamping groove 21, i.e., to enable part of the inner wall of the first through hole 41 to be clamped with the clamping groove 21 to restrict the center pole 2 from falling out of the first through hole 41 along an axial direction. Part of the side surface of the detachment preventing part 313 abuts against part of the inner wall of the groove 42 to restrict the locking piece 4 from falling out of the receiving chamber 311. Preferably, as illustrated in FIG. 1, FIG. 13 and FIG. 14, the elastic element is a spring 5, the locking piece 4 is provided with a protruding guide supporting part 43 at the end away from the opening 312, the guide supporting part 43 has a cross section of cross-shape and the spring 5 sleeves the guide supporting part 43, to guarantee that the locking piece 4 has good stability when moving inwards, and the overall structure also has good stability when the central lock is in the locked state.

Figure 4:
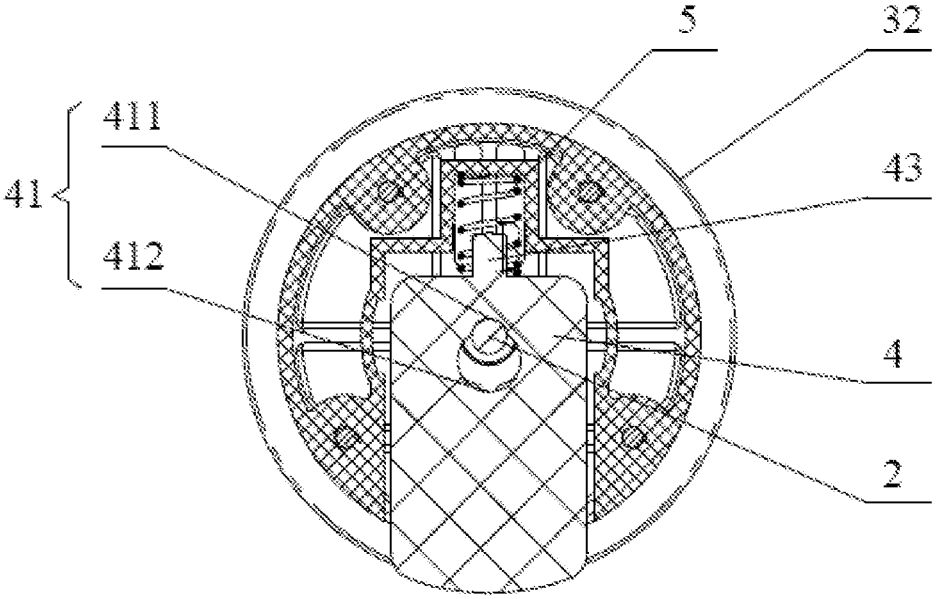
FIG. 4 illustrates a B-B sectional view of FIG. 2.
Figure 5:
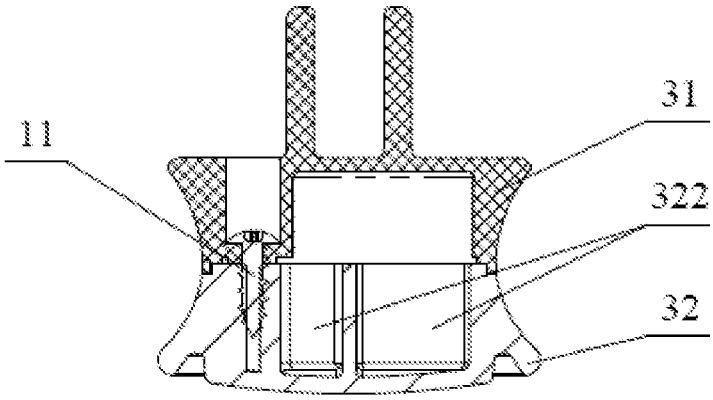
FIG. 5 illustrates a C-C sectional view of FIG. 2.
Figure 9:
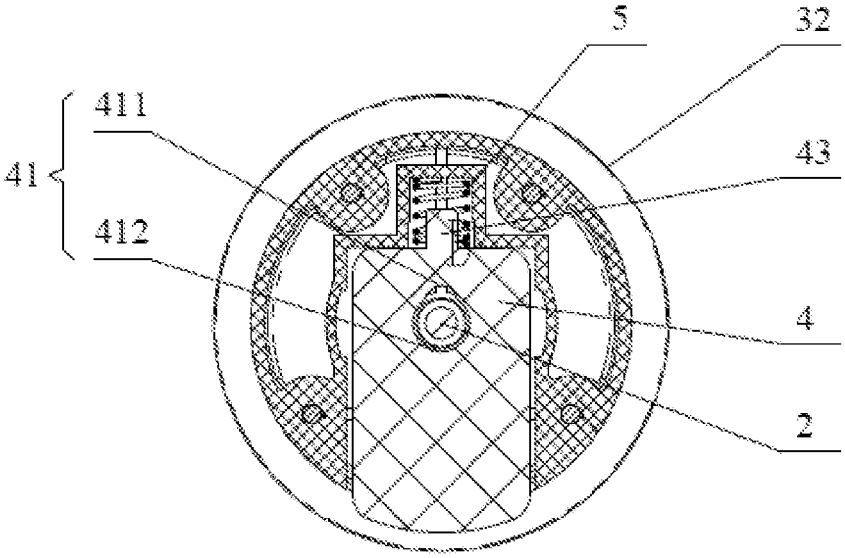
FIG. 9 illustrates an E-E sectional view of FIG. 7.
Figure 10:
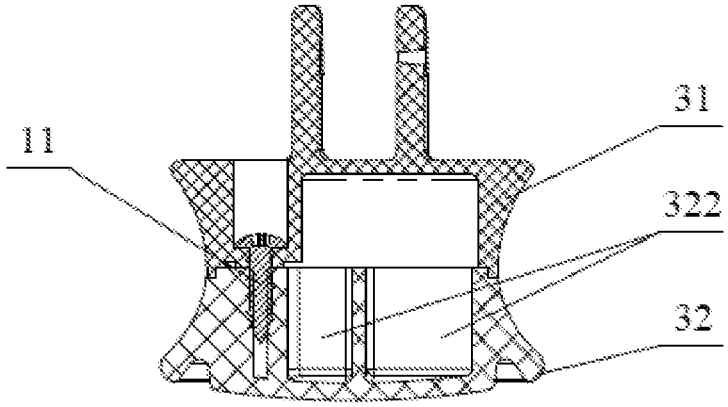
FIG. 10 illustrates an F-F sectional view of FIG. 7.
Figure 13:
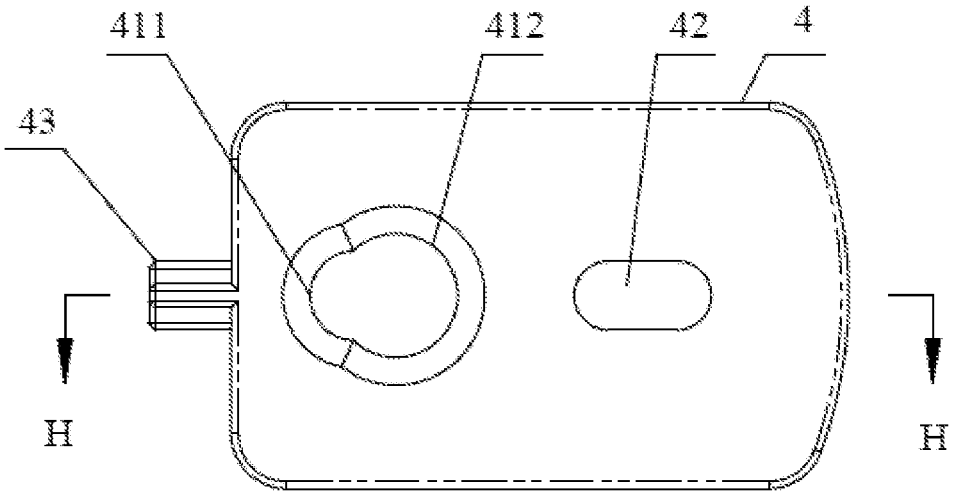
FIG. 13 illustrates a top view of a locking piece of the present invention.
Figure 14:
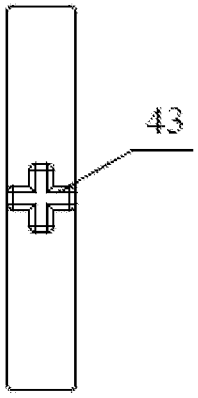
FIG. 14 illustrates a left view of FIG. 13.

Preferably, as illustrated in FIG. 13, the first through hole 41 comprises a clamping hole part 411 and a through hole part 412 arranged side by side, the clamping hole part 411 has a diameter not smaller than that of the clamping groove 21, i.e., the diameter of the clamping hole part 411 is equal to or slightly greater than the diameter of the clamping groove 21; the through hole part 412 has a diameter greater than that of the clamp locking part 22. Consequently, when the central lock is in the locked state, the clamping groove 21 at the lower end of the center pole 2 is clamped with the clamping hole part 411 of the first through hole 41, the center pole 2 and the through hole part 412 of the first through hole 41 are eccentrically arranged, as illustrated in FIG. 4, i.e., an axis of the center pole 2 and an axis of the through hole part 412 are in parallel but are not overlapped. When it needs to unlock the central lock, the user exerts force to push a locking piece pressing part 44 to enable the locking piece pressing part 44 to move inwards to compress the elastic element until the center rod 2 and the through hole part 412 of the first through hole 41 in the locking piece 4 are concentrically arranged, as illustrated in FIG. 9, i.e., the axis of the center pole 2 and the axis of the through hole part 412 are overlapped, the inner wall of the clamping hole part 411 is removed from the clamping groove 21 and thereby the clamp locking part 22 at the lower end of the center pole 2 can be removed from the through hole part 412.

Figure 23:
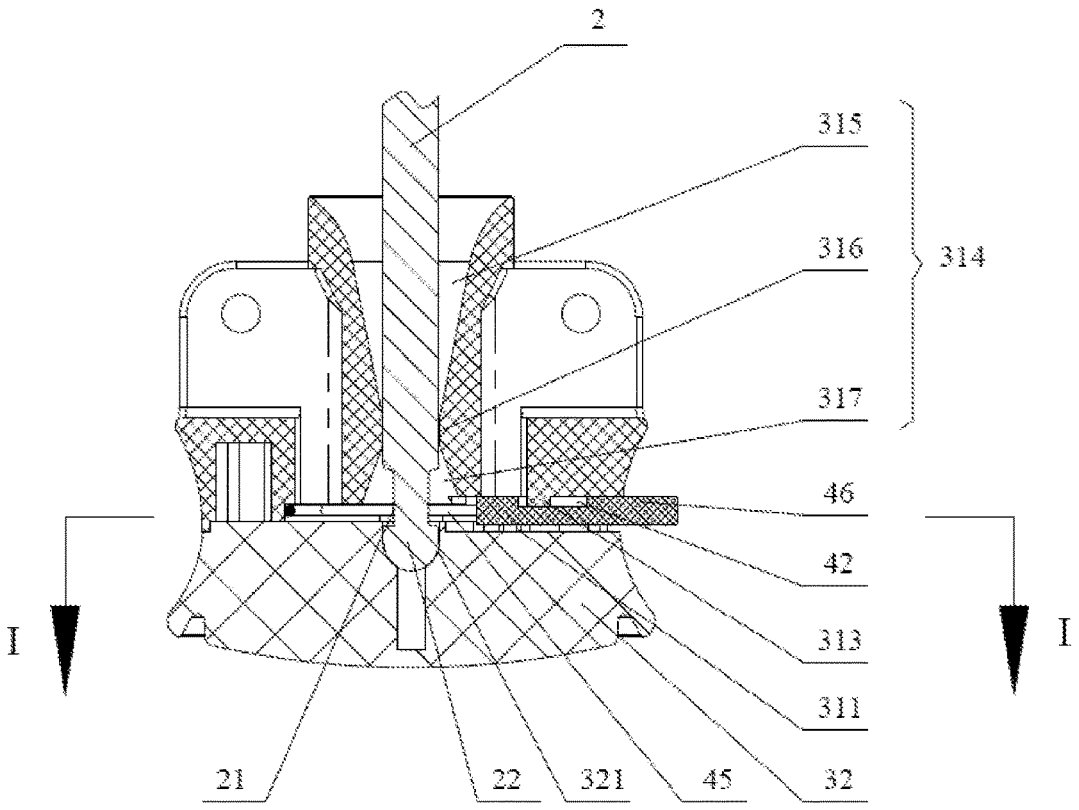
FIG. 23 illustrates a schematic view of a connection between the center pole and the center bottom cap when the central lock in FIG. 22 is in a locked state.
Figure 24:
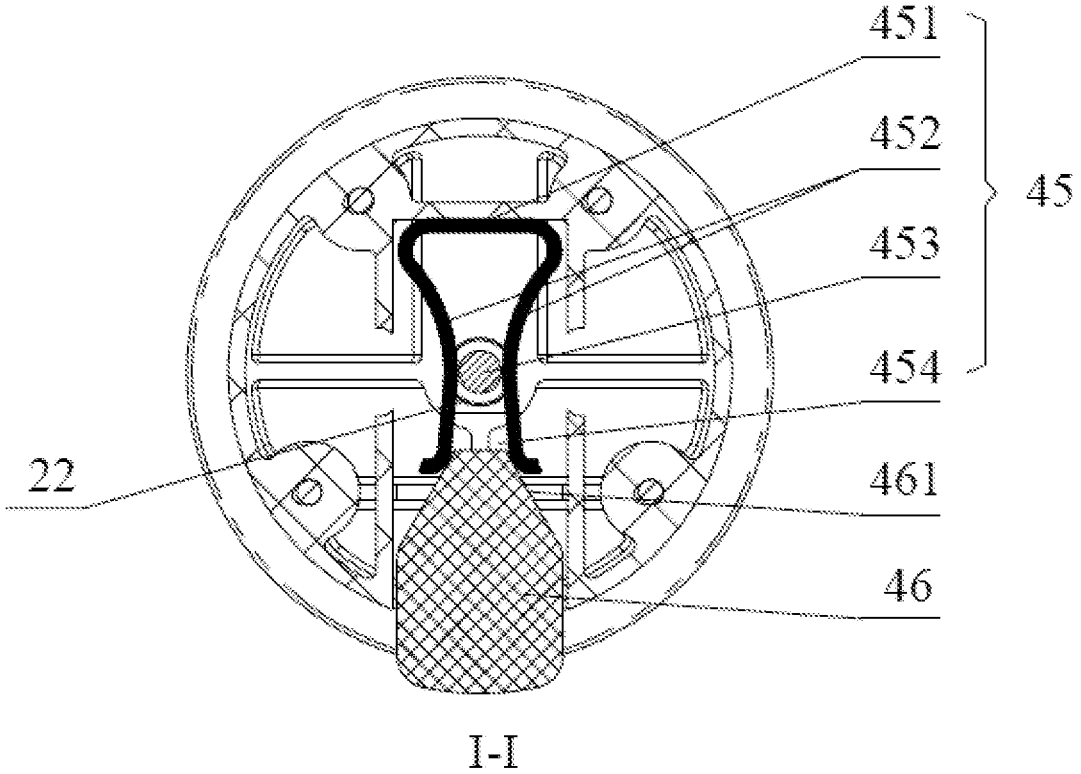
FIG. 24 illustrates an I-I sectional view of FIG. 23.
Figure 25:
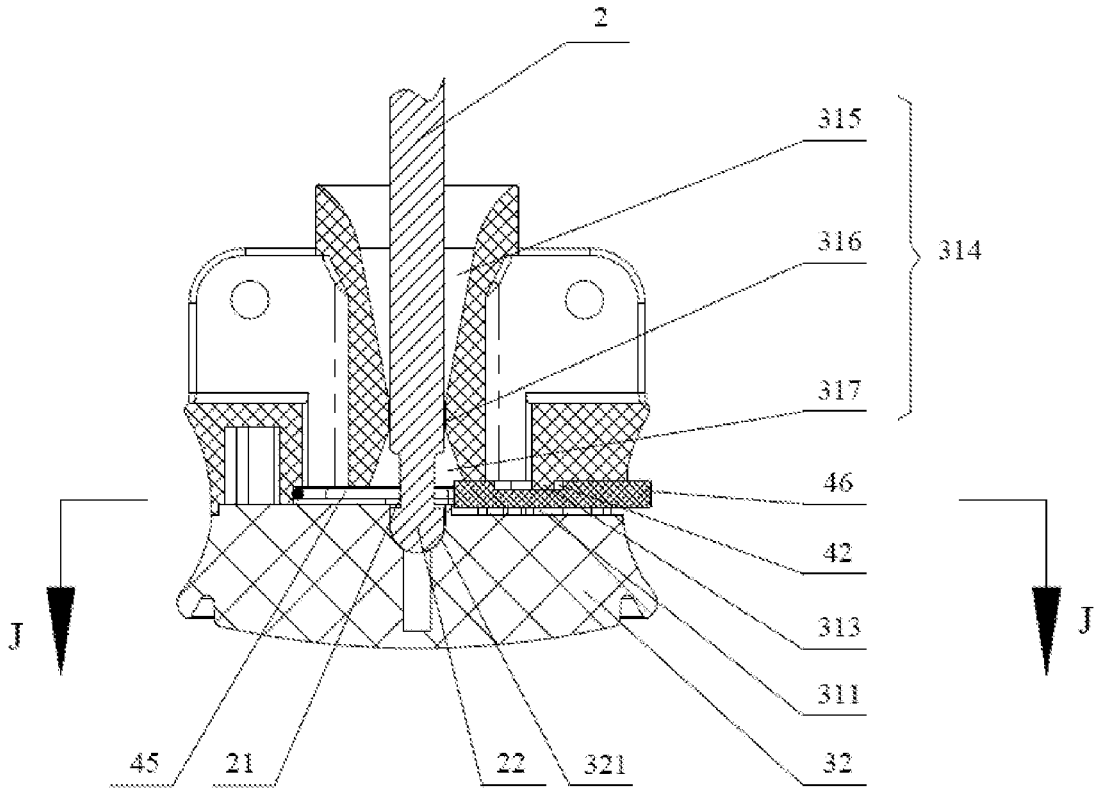
FIG. 25 illustrates a schematic view of a connection between the center pole and the center bottom cap when the central lock in FIG. 22 is in an unlocked state.
Figure 26:
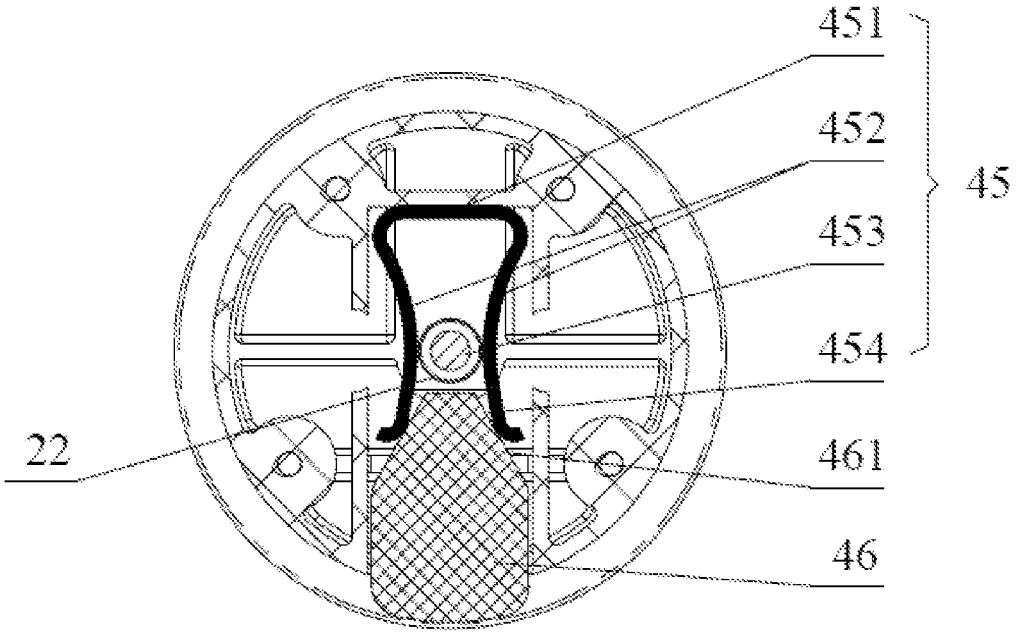
FIG. 26 illustrates a J-J sectional view of FIG. 25.

In the second embodiment, the locking piece 4 is in a detachable form, as illustrated in FIG. 22 to FIG. 26, and comprises an elastic wire 45 and an unlocking push piece 46, the elastic wire 45 is U-shaped and comprises an elastic wire body part 451 and two elastic deforming parts 452 respectively provided at two ends of the elastic wire body part 451, the two elastic deforming parts 452 are X-shaped with a narrow opening 453 for forming the first through hole 41 being provided in the middle of the two elastic deforming parts 452. The narrow opening 453 is an opening section having a smallest spacing between the elastic deforming parts 452, end portions of the elastic deforming parts 452 form a socket 454 and an inner end of the unlocking push piece 46 is located in the socket 454. In a natural state, the narrow opening 453 has a caliber smaller than or equal to the diameter of the clamping groove 21, when the center pole 2 is inserted into the center bottom cap 3, the clamp locking part 22 widens the narrow opening 453 until the clamping groove 21 in the center pole 2 is aligned with the inner wall of the narrow opening 453 of the elastic wire 45, then the narrow opening 453 is narrowed under the effect of the elastic restoring force of the elastic wire 45, thereby the inner wall of the narrow opening 453 is enabled to be clamped in the clamping groove 21 in the center pole 2, and thus the position locking of the center bottom cap 3 and the center top cap 1 is achieved, as illustrated in FIG. 23 and FIG. 24. When it needs to unlock, the unlocking push piece 46 is pressed and pushed inwards, the socket 454 of the elastic wire 45 is widened until the caliber of the narrow opening 453 is greater than the diameter of the clamp locking part 22, such that the clamp locking part 22 is capable of passing through the narrow opening 453, as illustrated in FIG. 25 and FIG. 26, consequently, the separation between the center top cap 1 and the center bottom cap 3 is achieved and the folding action of the canopy is achieved.

Preferably, as illustrated in FIG. 23 and FIG. 25, the bottom cap seat 31 is provided with a protruding detachment preventing part 313, the unlocking push piece 46 is provided with a groove 42 for receiving the detachment preventing part 313. With mutual cooperation between the detachment preventing part 313 and the groove 42, it enables to prevent the unlocking push piece 46 from falling out of the receiving chamber 311 as well as from being excessively pressed during unlocking. The unlocking push piece 46 is provided with two guide surfaces 416 in contact with the end portions of the elastic deforming parts 452 respectively, and the guide surfaces 461 are spread and inclining away from the elastic wire 45, i.e., an inner end of the unlocking push piece 46 is trapezoidal, so as to guarantee that the socket 454 and the narrow opening 453 of the elastic wire can be accurately widened when the unlocking push piece 46 is pushed inwards.

More preferably, in order to facilitate the movement of the locking piece 4, at least part of the locking piece 4 is disposed outside the center bottom cap 3 to form the locking piece pressing part 44.

Further, as illustrated in FIG. 6, the bottom cap seat 31 is provided with a second through hole 314 through which the center pole 2 can pass, the axis of the second through hole 314 coincides with the axis of the center pole 2. The bottom cap cover 32 is provided with a receiving hole 321 for receiving the clamp locking part 22 and being adaptive to an outer wall of the clamp locking part 22. The second through hole 314, the first through hole 41 and the receiving hole 321 are in a communication manner. When the central lock is in the locked state, the lower end of the center pole 2 is sequentially disposed in the second through hole 314 of the bottom cap seat 31 and the first through hole 41 of the locking member 4, the lamp locking part 22 is received in the receiving hole 321 of the bottom cap cover 32. Since the shape of the inner wall of the receiving hole 321 is adapted to the shape of the outer wall of the clamp locking part 22, the inner wall of the receiving hole 321 is fit with the outer wall of the clamp locking part 22, thereby the clamp locking part 22 of the center pole 2 can be prevented from shaking, jumping and the like under the effect of external force, and thus the locking reliability of the central lock is improved.

To sum up, during the locking of the central lock comprising the bottom cap seat 31, the bottom cap cover 32, the spring 5, the locking piece 4, the center pole 2, the center top cap 1 and the like, the user pushes the center bottom cap 3 to move upwards, and the distance between the center bottom cap 3 and the center top cap 1 gradually decreases. When no external force is applied to the locking piece 4, the locking piece 4 is only subjected to the elastic force of the spring 5, by which part of the inner wall of the groove 42 of the locking piece 4 abuts against part of the outer wall of the detachment preventing part 313 of the bottom cap seat 31, consequently, the locking ember 4 is still received in the receiving chamber 311 under the effect of the elastic force of the spring 5 and is unable to fall out of the receiving chamber 311, and the through hole part 412 of the first through hole 41 of the locking piece 4 and the second through hole 314 of the bottom cap seat 31 are eccentrically arranged. The user continues to push the center bottom cap 3 to move upwards until the lower end of the center pole 2 enters the second through hole 314 in the bottom cap seat 31. The user continues to apply force to move center bottom cap 3 upwards, and when the locking part 22 at the lower end of the center pole 2 enters the upper end of the first through hole 41 of the locking piece 4, the user applies acting force to overcome the pressure applied by the spring 5 to the locking piece 4 to move the locking piece inwards, so that the clamp locking part 22 at the lower end of the center pole 2 passes through the first through hole 41 of the locking piece 4 to be received in the receiving hole 321 of the bottom cap cover 32, further, the locking piece 4 is restored under the effect of the elastic force of the spring 5, so that the clamping hole part 411 of the first through hole 41 is enabled to be clamped with the clamping groove 21 of the center pole 2, thereby the connection between the center pole 2 and the center bottom cap 3 is completed and the locking of the central lock is achieved. During the unlocking, the user presses the locking piece pressing part 44 inwards to overcome the elastic force of the spring 5 to move the locking piece 4 inwards; when the inner wall of the clamping hole part 411 is separated from the clamping groove 21 and the center pole 22 is aligned with the through hole part 412 of the first through hole 41, the center bottom cap 3 is pulled to move downwards.

Figure 15:
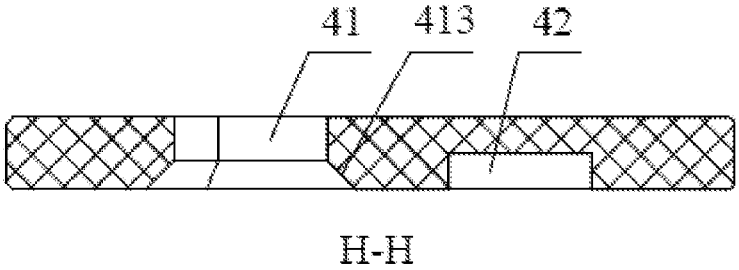
FIG. 15 illustrates an H-H sectional view of FIG. 13.

Further, in order to facilitate the center pole 2 to thread the bottom cap seat 31 and the locking piece 4, as illustrated in FIG. 6 and FIG. 11, the second through hole 314 sequentially comprises a first conical part 315 with a gradually decreased diameter, a cylindrical part 316 and a second conical part 317 with a gradually increased diameter along the direction that the center pole 2 threads the center bottom cap 3, and a diameter of the cylindrical part 316 is slightly greater than the diameter of the center pole 2. Consequently, as the bottom cap seat 31 moves upwards to be connected with the lower end of the center pole 2, the opening of the first conical part 315 at the upper end of the second through hole 314 is relatively larger to facilitate the clamp locking part 22 to be inserted into the bottom cap seat 31. As illustrated in FIG. 15, the upper end of the first through hole 41 is chamfered to form a chamfered part 413 with a gradually decreased diameter, thus the opening at the upper end of the first through hole 41 is also relatively large and has a certain inclination to facilitate the clamp locking part 22 to be inserted into the locking piece 4, so as to play a role of guiding. When the center pole 2 is separated from the center bottom cap 3, the bottom cap seat 31 moves downwards, and the opening of the second conical part 317 at the lower end of the second through hole 314 is relatively large to facilitate the clamp locking part 22 to fall out of the second through hole 314. Preferably, the clamping groove 21 is an annular groove, an end portion of the clamp locking part 22 is provided with a guide part 221 of a semispherical shape or a conical shape with a gradually decreased diameter, by which the guide part 221 facilitates entering the first through hole 41 of the locking piece 4 and abrasion hardly occurs.

Further, as illustrated in FIG. 1, in the case that the structural strength of the central lock is guaranteed, the bottom cap seat 32 is provided with a plurality of material reducing grooves 322 to reduce the amount of material and lower the cost. In addition, the center bottom cap 3 has an arc-shaped side surface to facilitate grasping the center bottom cap 3.

To sum up, the present invention effectively overcomes various disadvantages in the prior art and thus has a great industrial utilization value.

What is claimed is:

1. A central lock, comprising a center pole (2), a center top cap (1) fixedly arranged at one end of the center pole (2) and a center bottom cap (3) detachably connected to the other end of the center pole (2), wherein, a locking piece (4) capable of moving back and forth along a radial direction of the center pole (2) is received in the center bottom cap (3), a first through hole (41) through which the center pole (2) can pass through is provided in the locking piece (4), and a portion of the other end of the center pole (2) is provided with a clamping groove (21) and a clamp locking part (22) located at the lower end of the clamping groove (21); when the central lock is in a locked state, part of an inner wall of the first through hole (41) of the locking piece (4) is clamped with the clamping groove (21) of the center pole (2), and an upper end surface of the clamp locking part (22) abuts against a lower end surface of the locking piece (4); and when the central lock is in an unlocked state, the inner wall of the first through hole (41) of the locking piece (4) is separated from the clamping groove (21) and the clamp locking part (22) can pass through the first through hole (41), and wherein the center bottom cap (3) comprises a bottom cap seat (31) and a bottom cap cover (32) that are fixedly connected to one another, a receiving chamber (311) is provided in the center bottom cap (3) at a junction between the bottom cap seat (31) and the bottom cap cover (32), an opening (312) communicated with the receiving chamber (311) is provided in an outer wall of the center bottom cap (3), the locking piece (4) is provided threading the receiving chamber (311) and the opening (312) and supported by the bottom cap cover (32), and wherein the locking piece (4) is an integral structure, the receiving chamber (311) is provided with a compressible elastic element along a radial direction of the center pole (2), the elastic element abuts against the locking piece (4) and an inner wall of the receiving chamber (311) at two ends respectively, the bottom cap seat (31) is provided with a protruding detachment preventing part (313), the locking piece (4) is provided with a groove (42) for receiving the detachment preventing part (313); when the central lock is in a locked state, the elastic element enables part of the inner wall of the first through hole (41) to be clamped with the clamping groove (21), and the detachment preventing part (313) abuts against an inner wall of the groove (42).

2. The central lock according to claim 1, wherein: the elastic element is a spring (5), the locking piece (4) is provided with a protruding guide supporting part (43) at the end away from the opening (312), and the spring (5) sleeves the guide supporting part (43).

3. A central lock, comprising a center pole (2), a center top cap (1) fixedly arranged at one end of the center pole (2) and a center bottom cap (3) detachably connected to the other end of the center pole (2), wherein, a locking piece (4) capable of moving back and forth along a radial direction of the center pole (2) is received in the center bottom cap (3), a first through hole (41) through which the center pole (2) can pass through is provided in the locking piece (4), and a portion of the other end of the center pole (2) is provided with a clamping groove (21) and a clamp locking part (22) located at the lower end of the clamping groove (21); when the central lock is in a locked state, part of an inner wall of the first through hole (41) of the locking piece (4) is clamped with the clamping groove (21) of the center pole (2), and an upper end surface of the clamp locking part (22) abuts against a lower end surface of the locking piece (4); and when the central lock is in an unlocked state, the inner wall of the first through hole (41) of the locking piece (4) is separated from the clamping groove (21) and the clamp locking part (22) can pass through the first through hole (41), and wherein the center bottom cap (3) comprises a bottom cap seat (31) and a bottom cap cover (32) that are fixedly connected to one another, a receiving chamber (311) is provided in the center bottom cap (3) at a junction between the bottom cap seat (31) and the bottom cap cover (32), an opening (312) communicated with the receiving chamber (311) is provided in an outer wall of the center bottom cap (3), the locking piece (4) is provided threading the receiving chamber (311) and the opening (312) and supported by the bottom cap cover (32), and wherein the locking piece (4) is in a detachable form and comprises an elastic wire (45) and an unlocking push piece (46), the elastic wire (45) is U-shaped and comprises an elastic wire body part (451) and two elastic deforming parts (452) respectively provided at two ends of the elastic wire body part (451), a narrow opening (453) for forming the first through hole (41) is provided in the middle of the two elastic deforming parts (452), end portions of the elastic deforming parts (452) form a socket (454) and an inner end of the unlocking push piece (46) is located in the socket (454); when the central lock is in an unlocked state, the unlocking push piece (46) widens the socket (454) and the narrow opening (453) of the elastic wire (45).

4. The central lock according to claim 3, wherein: the bottom cap seat (31) is provided with a protruding detachment preventing part (313), the unlocking push piece (46) is provided with a groove (42) for receiving the detachment preventing part (313); when the central lock is in a locked state, the detachment preventing part (313) abuts against an inner wall of the groove (42).

5. The central lock according to claim 3, wherein: the unlocking push piece (46) is provided with two guide surfaces (416) in contact with the end portions of the elastic deforming parts (452) respectively, and the guide surfaces (461) are spread and inclining away from the elastic wire (45).

6. A central lock, comprising a center pole (2), a center top cap (1) fixedly arranged at one end of the center pole (2) and a center bottom cap (3) detachably connected to the other end of the center pole (2), wherein, a locking piece (4) capable of moving back and forth along a radial direction of the center pole (2) is received in the center bottom cap (3), a first through hole (41) through which the center pole (2) can pass through is provided in the locking piece (4), and a portion of the other end of the center pole (2) is provided with a clamping groove (21) and a clamp locking part (22) located at the lower end of the clamping groove (21); when the central lock is in a locked state, part of an inner wall of the first through hole (41) of the locking piece (4) is clamped with the clamping groove (21) of the center pole (2), and an upper end surface of the clamp locking part (22) abuts against a lower end surface of the locking piece (4); and when the central lock is in an unlocked state, the inner wall of the first through hole (41) of the locking piece (4) is separated from the clamping groove (21) and the clamp locking part (22) can pass through the first through hole (41), and wherein the center bottom cap (3) comprises a bottom cap seat (31) and a bottom cap cover (32) that are fixedly connected to one another, a receiving chamber (311) is provided in the center bottom cap (3) at a junction between the bottom cap seat (31) and the bottom cap cover (32), an opening (312) communicated with the receiving chamber (311) is provided in an outer wall of the center bottom cap (3), the locking piece (4) is provided threading the receiving chamber (311) and the opening (312) and supported by the bottom cap cover (32), and wherein the bottom cap seat (31) is provided with a second through hole (314) through which the center pole (2) can pass, the bottom cap cover (32) is provided with a receiving hole (321) for receiving the clamp locking part (22) and being adaptive to an outer wall of the clamp locking part (22), the second through hole (314), the first through hole (41) and the receiving hole (321) are in a communication manner, and wherein the second through hole (314) sequentially comprises a first conical part (315) with a gradually decreased diameter, a cylindrical part (316) and a second conical part (317) with a gradually increased diameter along the direction that the center pole (2) threads the center bottom cap (3), the upper end of the first through hole (41) is provided with a chamfered part (413) with a gradually decreased diameter.

7. A central lock, comprising a center pole (2), a center top cap (1) fixedly arranged at one end of the center pole (2) and a center bottom cap (3) detachably connected to the other end of the center pole (2), wherein, a locking piece (4) capable of moving back and forth along a radial direction of the center pole (2) is received in the center bottom cap (3), a first through hole (41) through which the center pole (2) can pass through is provided in the locking piece (4), and a portion of the other end of the center pole (2) is provided with a clamping groove (21) and a clamp locking part (22) located at the lower end of the clamping groove (21); when the central lock is in a locked state, part of an inner wall of the first through hole (41) of the locking piece (4) is clamped with the clamping groove (21) of the center pole (2), and an upper end surface of the clamp locking part (22) abuts against a lower end surface of the locking piece (4); and when the central lock is in an unlocked state, the inner wall of the first through hole (41) of the locking piece (4) is separated from the clamping groove (21) and the clamp locking part (22) can pass through the first through hole (41), and wherein the first through hole (41) comprises a clamping hole part (411) and a through hole part (412) arranged side by side, the clamping hole part (411) has a diameter not smaller than that of the clamping groove (21), the through hole part (412) has a diameter greater than that of the clamp locking part (22).

8. A collapsible canopy with a center lock, said collapsible canopy comprising:

A. at least three supporting legs,

B. a plurality of outer retractable units connected between every two adjacent supporting legs, and C. a plurality of inner retractable units connected to each supporting leg, wherein said outer retractable units and said inner retractable units form a roof frame for said collapsible canopy, and D. a center lock, wherein said plurality of inner retractable units are connected through said center lock, said center lock comprising:

i. a center top cap, ii. a center pole, comprising:

1. a center pole top end rigidly connected to said center top cap,
2. a center pole bottom end,
3. a clamping groove, and
4. a clamp locking part located at the lower end of said clamping groove, and iii. a center bottom cap detachably connected to said center pole bottom end, said center bottom cap comprising:

1. a spring loaded locking piece for engaging said clamping groove, and
2. a clamp locking part receiving section for receiving said clamp locking part, wherein when said center lock is in a locked state, said spring loaded locking piece is engaged with said clamping groove and said clamp locking part is inserted into said clamp locking part receiving section, wherein when said center lock is in an unlocked state said center pole is detached from said center bottom cap.

9. The collapsible canopy as in claim 8, wherein said spring loaded locking piece comprises a spring compressed between said locking piece and said center bottom cap.

10. The collapsible canopy as in claim 8, wherein said spring loaded locking piece comprises a U-shaped elastic wire positioned between said locking piece and said center bottom cap.

11. The collapsible canopy as in claim 8, wherein said collapsible canopy is locked by pressing upwards on said center bottom cap until said center bottom cap is locked onto said clamping groove of said center pole and wherein said collapsible canopy is unlocked by disengaging said locking piece from said clamping groove of said center pole and by lowering said center bottom cap away from said center pole.

* * * * *